US005182600A

United States Patent [19]

Hasegawa et al.

[11] Patent Number: 5,182,600

[45] Date of Patent: Jan. 26, 1993

[54] TONER END DETECTING METHOD FOR AN ELECTROPHOTOGRAPHIC COPIER

[75] Inventors: Shin Hasegawa, Kawasaki; Hajime Oyama, Ichikawa; Eiichi Katoh, Tokyo; Masao Moriya, Yokohama, all of Japan

[73] Assignee: Ricoh Company, Ltd., Tokyo, Japan

[21] Appl. No.: 799,941

[22] Filed: Nov. 29, 1991

[30] Foreign Application Priority Data

Nov. 30, 1990 [JP] Japan ..... 2-337643

[51] Int. Cl.[5] ..... G03G 21/00

[52] U.S. Cl. ..... 355/246; 355/77; 355/208

[58] Field of Search ..... 355/203, 204, 208, 245, 355/246, 77, 206; 430/31

[56] References Cited

U.S. PATENT DOCUMENTS

| | | | |
|---|---|---|---|
| 4,801,980 | 1/1989 | Arai et al. | 355/246 X |
| 4,833,506 | 5/1989 | Kuru et al. | 355/208 |
| 5,005,517 | 4/1991 | Fukui et al. | 355/246 X |
| 5,006,896 | 4/1991 | Koichi et al. | 355/246 |
| 5,035,198 | 7/1991 | Niito | 355/208 X |
| 5,095,331 | 3/1992 | Takano | 355/203 |

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

A toner end detecting method for an electrophotographic copier which allows the copier to operate even when a toner end condition is detected by accident or when a developing device included in the copier and being used is replaced with another storing a toner of the same color while a toner end condition is not reached. When the power source of the copier is turned off and then on or when the developing device is set on the copier, the method executes a recovery procedure.

8 Claims, 18 Drawing Sheets

| |
|---|
| Fig. 13A |
| Fig. 13B |

P SENSOR SAMPLING
SHIFT SAMPLING DATA BUFFER
READ P SENSOR OUTPUT
STORE READ DATA IN SAMPLING DATA BUFFER 0
Vsp CHECK MODE ?
YES
NO
INCREMENT Vsp CHECK COUNTER
READ DATA<A8H ?
YES
NO
Vsp CHECK COUNTER > 16 ?
YES
NO

TONER END DETECTING METHOD FOR AN ELECTROPHOTOGRAPHIC COPIER

BACKGROUND OF THE INVENTION

The present invention relates to a toner end detecting method for an electrophotoraphic copier which allows the copier to operate even when a toner end condition is detected by accident or when a developing device incorporated in the copier is replaced with another storing a toner of the same color while a toner end condition is not detected.

Generally, an electrophotoraphic copier has a photoconductive drum or similar image carrier for electrostatically forming a latent image thereon by imagewise exposure. The latent image is developed by a developing device and then transferred transferred to a recording medium as a toner image. The toner remaining on the drum after the image transfer is removed by a cleaning device. The developing device is made up of a developing section for developing the latent image by supplying a developer to the drum, and a toner supply section for supplying a fresh toner to the developing section. The developer may be implemented as a two-component developer consisting of a black toner and a carrier or of a monocolor toner and a carrier. When the toner supply section runs out of toner, i.e., in a toner end condition, a toner end detecting device detects it and causes a display to inform the user of such a condition. In response, the user fills the toner supply section with a fresh toner or replaces the entire developing device having the toner supply section with a new developing device whose toner supply section is full fresh toner. It is a common practice with the toner end detecting device to use a single toner end detection condition in determining whether or not the toner supply section has run out of toner. The toner end detecting device, therefore, is apt to accidentally detect a toner end condition when the developing ability of the developing device changes due to the change in temperature and/or humidity while the copier is in use. In light of this, there has been proposed a method which selectively uses one of a plurality of toner end detection conditions in determining whether or not the toner supply section has run out of toner.

In a copier of the type described, if the user operates the copier without filling the toner supply section with a toner or without replacing the developing device despite the toner end condition, the toner concentration of the developer stored in the developing section will be excessively lowered to render the image density short or to cause the local omission of an image to occur. Moreover, much carrier deposits on the drum to break a cleaning blade and thereby scratches the surface of the drum. While the copier may be inhibited from operating when a toner end condition is detected, it will be inhibited from doing so even when a toner end is detected by accident due to the rapid consumption of toner as would occur in the event of continuous reproduction of documents whose substantial areas are occupied by images. For this reason, it has been customary to allow an electrophotographic copier to produce at least several ten copies after the power source thereof has been turned on again. It has also been customary to cause, when the developing device is replaced with another storing a toner of different color, a toner color sensing device to sense it and cancel the inhibition.

A maintenance free copier is available which uses a miniature developing device and allows the user of the copier to effect maintenance, as desired. The problem with this kind of copier using a miniature developing device is that when the user does not notice a toner end condition and continuously operates the copier without filling the toner supply section with a toner or replacing the developing device, the toner concentration of the developer stored in the developing section sharply decreases. More specifically, the interval between the detection of the toner end condition and the occurrence of the previously mentioned defective image and the adverse effect on the copier body is extremely short. The copier with such user oriented maintenance has to be protected at least from the adverse influence on the copier body. It is, therefore, difficult to allow the copier to produce several copies after the power source has been turned on again, i.e., it is necessary to inhibit the copier from operating after the detection of a toner end condition. This, again, results in the problem that the copier is unoperable when a toner end detection is detected by accident. When the developing device is replaced with another storing a sufficient amount of toner in the toner supply section thereof, the toner end detecting device does not detect a toner end condition any more, allowing the copier to operate. The copier is also allowed to operate when the developing device is replaced with another storing a toner of different color. However, when the developing device in use and not run out of toner is replaced with another storing a toner of the same color, the copier is inhibited from operating when the developing device in use is removed from the copier body and remains in the inhibited state thereafter. This is especially true with a miniature developing device since it is sometimes used as a key counter.

SUMMARY OF THE INVENTION

It is, therefore, an object of the present invention to provide a toner end detecting method for an electrophotographic copier which allows the copier to operate even when a toner end condition is accidentally detected or when the developing device thereof not run out of toner is replaced with another storing a toner of the same color.

It is another object of the present invention to provide a generally improved toner end detecting method for an electrophotographic copier.

In accordance with the present invention, in a toner end detecting method for an electrophotographic copier comprising the steps of electrostatically forming a latent image of a reference pattern on a photoconductive element, developing the latent image by a developing section of a developing device for producing a toner image, determining the density of the toner image and the density of the background of the photoconductive element by a density sensory, controlling the supply of a toner supply section of the developing device to the developing section on the basis of a ratio of the outputs of the density sensor representative of the density of the background and the density of the toner image, respectively, and inhibiting a copying operation on determining that the toner supply section has reached a toner end condition, a recovery procedure is executed such that if the toner supply section has reached a toner end condition as determined on the basis of the ratio, a toner end mode is set up, while if the toner supply section has not reached a toner end condition when a power source of the copier is turned off and then turn on or when the developing device is set on the copier as determined on the basis of the ratio, the toner end mode is cancelled.

Also, in accordance with the present invention, in a toner end detecting method of the type described, a recovery procedure is executed such that if the toner supply section has reached a toner end condition as determined on the basis of the ratio and any one of a plurality of toner end detection conditions, a toner end mode is set up, while if the toner supply section has not reached a toner end condition when a power source of the copier is turned off and then on or when the developing device is set on the copier as determined on the basis of the ratio, the toner end mode is cancelled.

BRIEF DESCRIPTION OF THE INVENTION

The above and other objects, features and advantages of the present invention will become more apparent from the following detailed description taken with the accompanying drawing in which.

DESCRIPTION OF THE PREFERRED EMBODIMENTS

Figure 1:
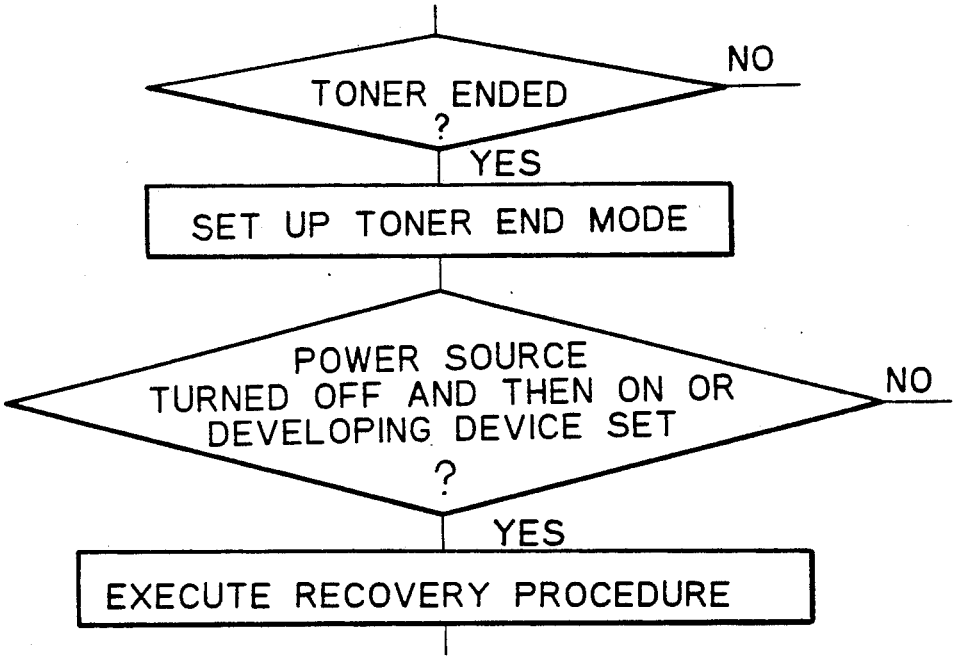
FIGS. 1-7 are flowcharts demonstrating specific procedures representative of a toner end detecting method in accordance with the present invention.
Figure 2:
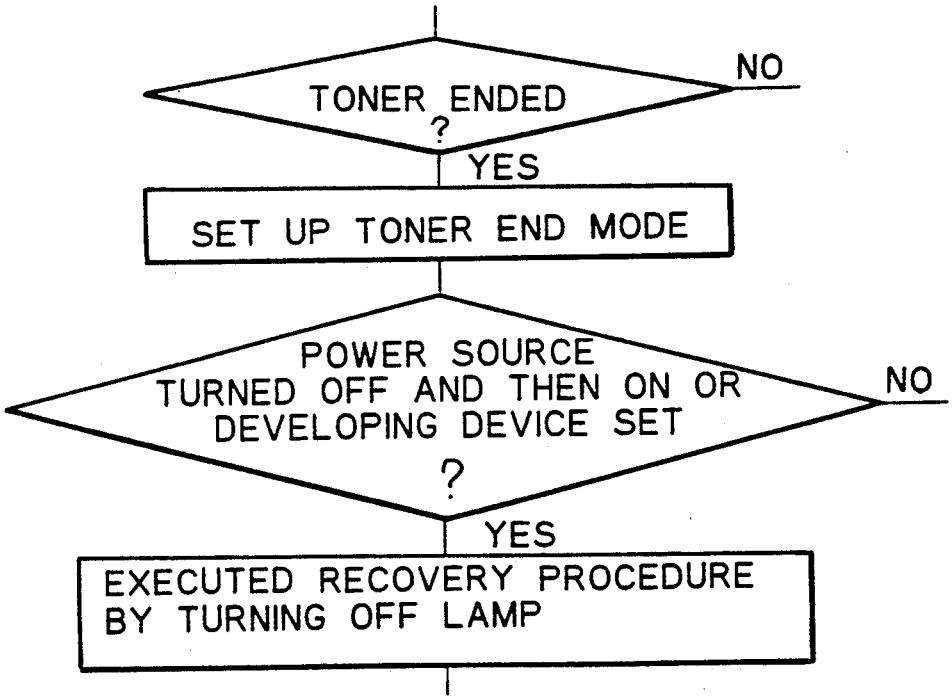
Figure 3:
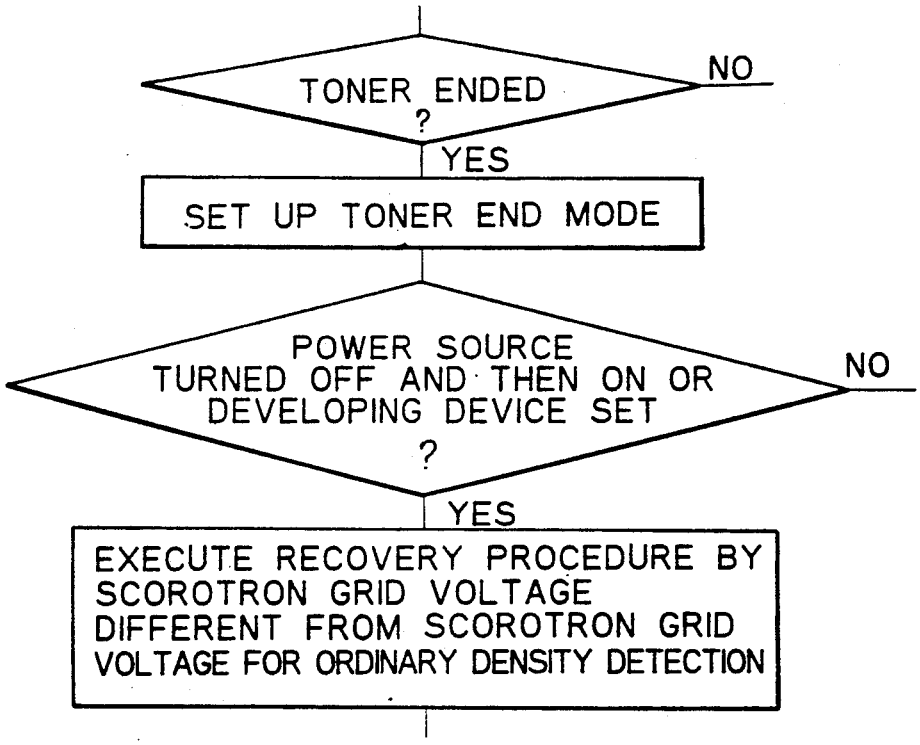
Figure 4:
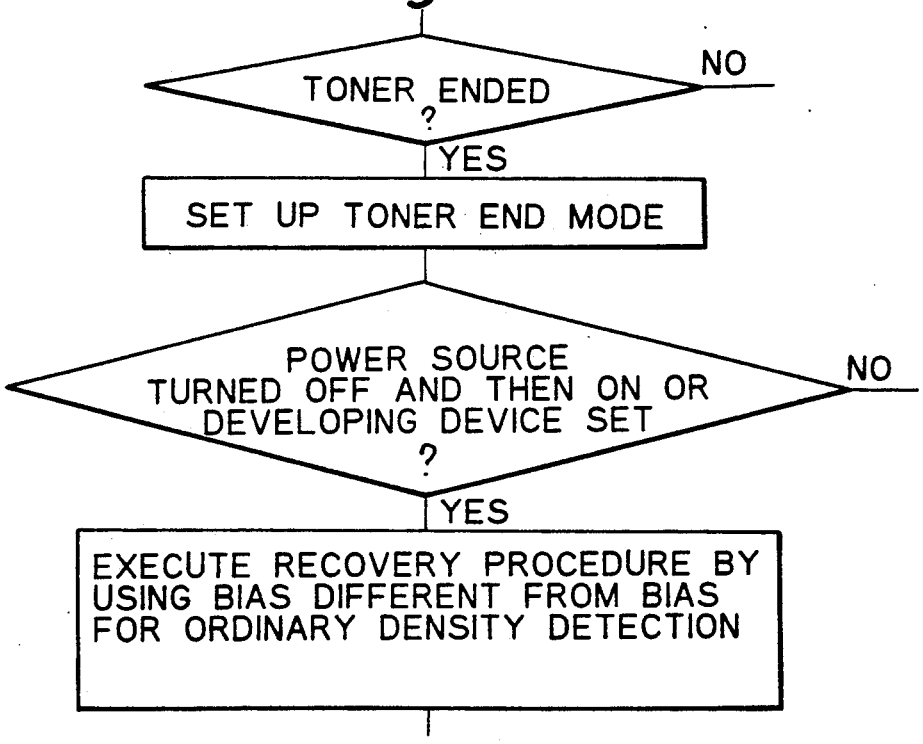
Figure 5:
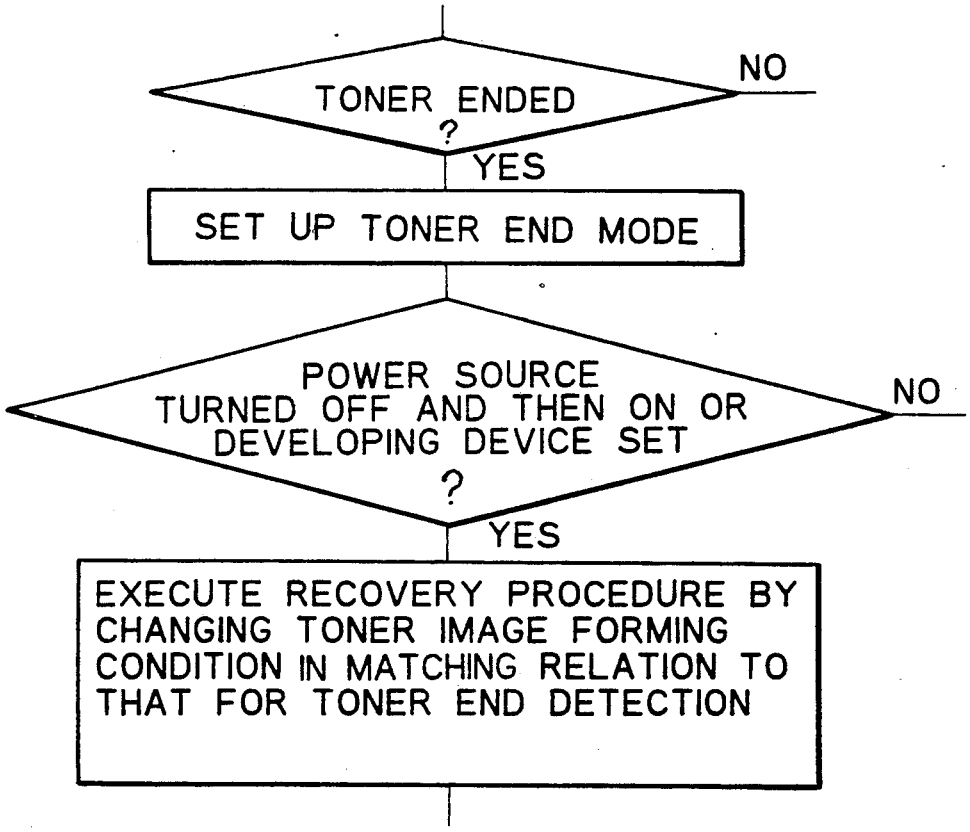
Figure 6:
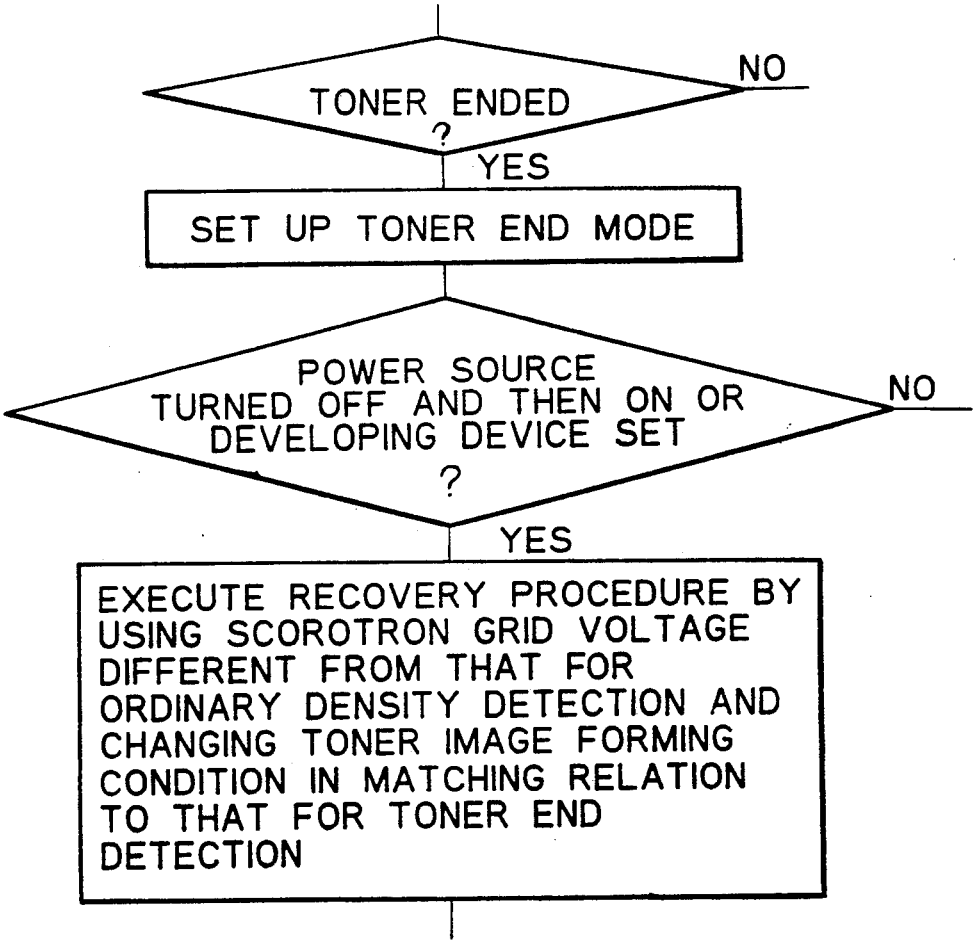
Figure 7:
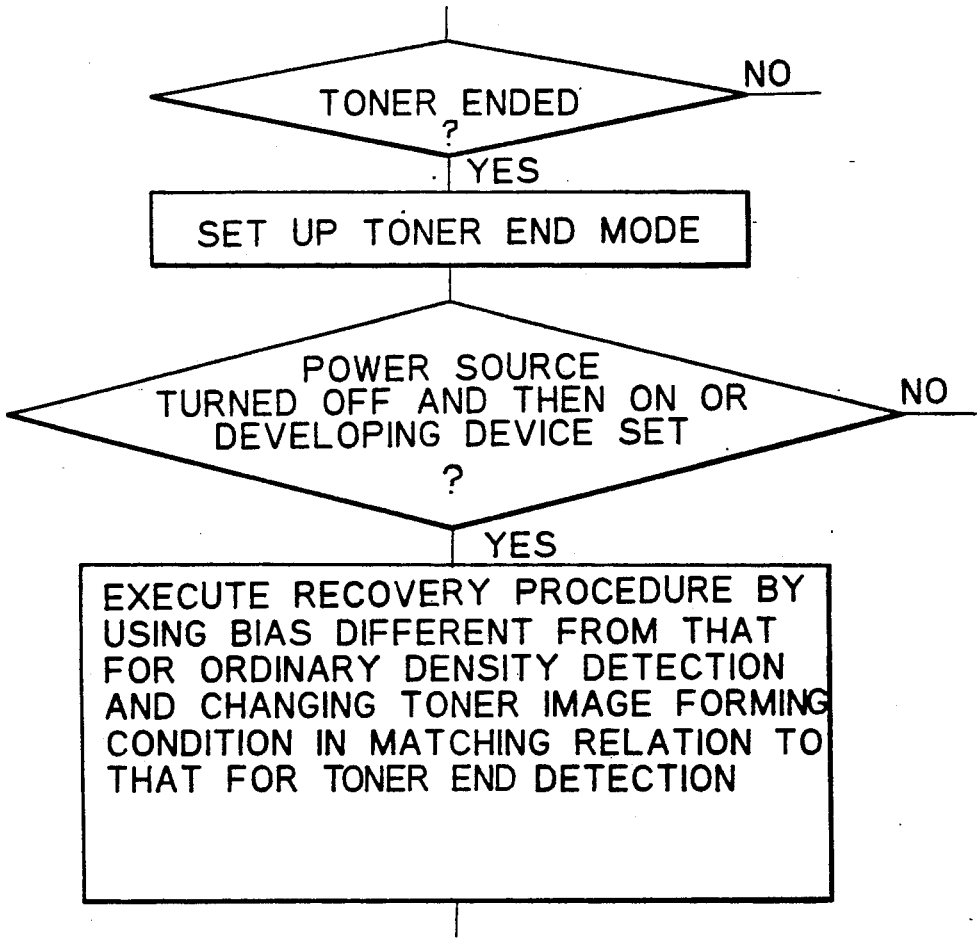
Figure 8:
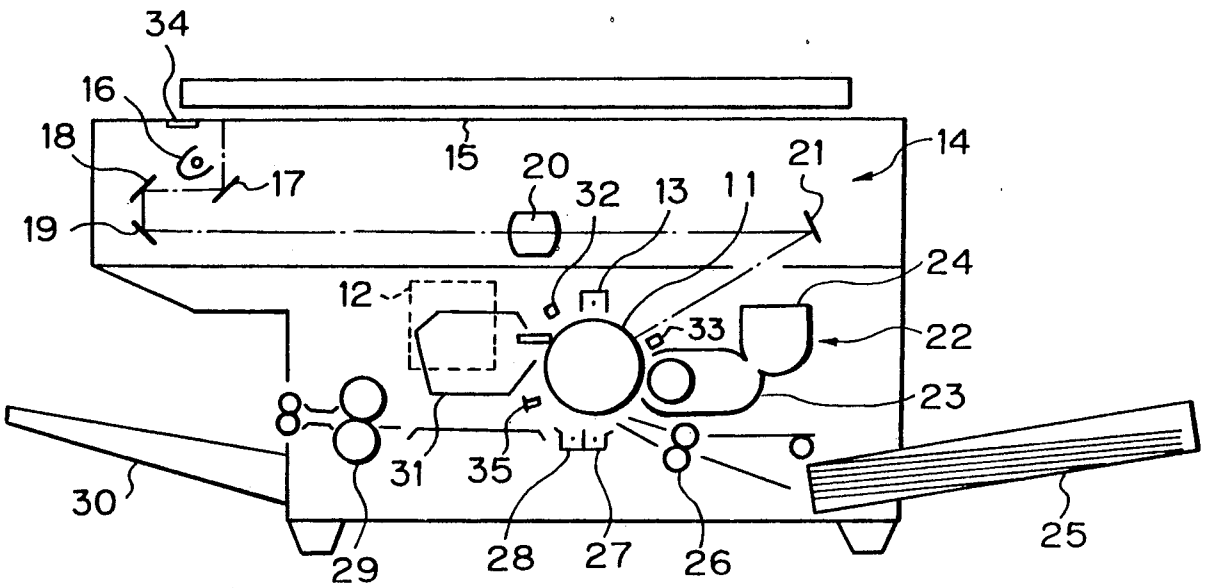
FIG. 8 is a section showing a specific construction of a copier to which the present invention is applied.

Referring to FIG. 8 of the drawings, a specific construction of a copier using a toner end detecting method of the present invention is shown and includes a photoconductive drum 11. When a copy start switch provided on the copier is pressed, a main motor 12 is energized to rotate the drum. A main charger in the form of a scorotron charger 13 uniformly charges the surface of drum 11 being rotated, and then optics 14 electrostatically forms a latent image on the drum 11. Thereafter, an eraser 33 dissipates the charge from needless areas of the drum 11. Specifically, the optics 14 includes a lamp 16 for illuminating a document laid on a glass platen 15. A reflection from the document is routed through mirrors 17-19, a lens 20 and a mirror 21 to the drum 11. At the same time, a scanner including the lamp 16 and mirrors 17-19 is moved forward to scan the document and then returned to a home position thereof. A developing device 22 has a developing section 23 and a toner supply section 24. The developing section 23 supplies a two-component developer, i.e., a mixture of toner and carrier to the drum 11 to develop the latent image, thereby producing a toner image on the drum 11. The toner supply section 24 supplies a toner to the developer existing in the developing section 3. A sheet feeder 25 feeds a recording sheet to a register roller 26. The register roller 26 drives the sheet at a predetermined timing such that the leading edge of the sheet meets that the leading edge of the toner image. A corona discharger 27 transfers the toner image from the drum 11 to the sheet. The sheet carrying the toner image thereon is separated from the drum 11 by another corona discharger 28 and then transported to a fixing device 29. After the toner image has been fixed on the sheet by the fixing device, the sheet or copy is driven out onto a copy tray 20. After the sheet has been separated from the drum 11, a cleaning device 31 removes the toner remaining on the drum 11. Further, a discharger 32 dissipates the charge remaining on the drum 11 to prepare the drum 11 for another copying cycle. Such a procedure is repeated until a particular number of copies entered on an operating section have been produced.

The toner concentration of the developer is controlled once per n consecutive copying cycles. For this purpose, a reference pattern 34 having a predetermined density is located to precede the glass platen 15. The scanner 16-19 scans the reference pattern 34 before the document when it starts on a forward movement. Therefore, a latent image representative of the reference pattern 34 is electrostatically formed on the drum 11. The eraser 33 erases such a latent image of the reference pattern thirty-four $(n-1)$ times per n copying cycles, i.e., the latent image is left on the drum 11 once per n copying cycles. As the developing device 23 develops the latent image of the reference pattern 34, a density sensor 35 senses the density of the resulting toner image. The density sensor is implemented by a reflection type photosensor of P sensor. After the density sensor or P sensor 35 has sensed the image density, the cleaning device 31 removes the toner image from the drum 11 and the discharger 32 discharges the drum 11.

Figure 9:
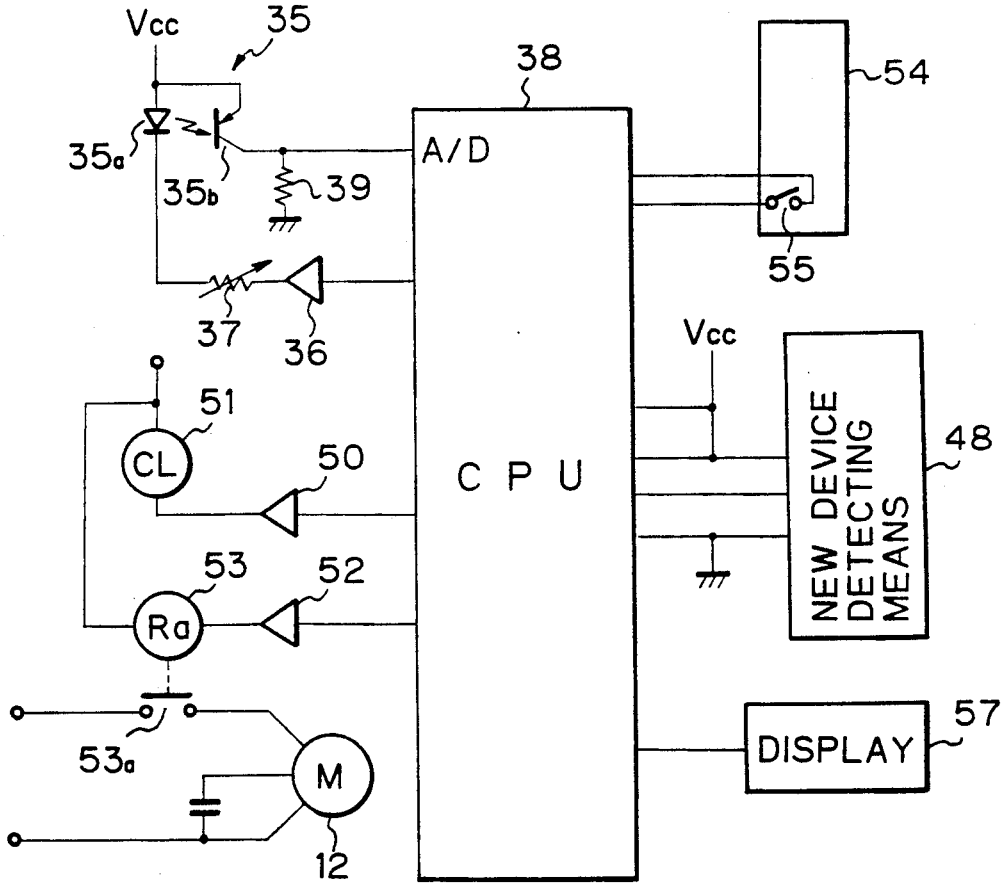
FIG. 9 is a block diagram schematically showing a circuit arrangement of the copier shown in FIG. 8.

As shown in FIG. 9, the P sensor 35 is made up of a light emitting diode (LED) **35*a* and a phototransistor 35*b*. The phototransistor 35*b* is connected between a power source Vcc and the output terminal of a buffer 36. A variable resistor 37 intervenes between the phototransistor 35*b* and the buffer 36. A microcomputer (CPU) 38 controls the eraser 33 to erase the latent image of the reference pattern thirty-four $(n-1)$ times per n copying cycles. At the same time, the CPU 38 delivers a control signal to the buffer 36 to turn on the LED 35 at the time for sensing the background density of the drum 11 and the density of the toner image of the reference pattern 34. As a result, light is issued from the LED 35*a* and then reflected by the drum 11 to reach the phototransistor 35*b*. The phototransistor 35*b* is connected between the power source Vcc and ground while a resistor 39 intervenes between the phototransistor 35*b* and ground. The collector output of the phototransistor 35*b* is applied to the CPU 38 as an output signal of the P sensor 35. The emission from the LED 35*a* is adjusted by the variable resistor 37 such that the output signal of the P sensor 35 associated with the background of the drum 11** where no toner is deposited is 4 volts.

Specifically, the P sensor 35 outputs a signal voltage Vsg representative of the background of the drum 11 and a signal voltage Vsp representative of the toner image of the reference pattern 34. The CPU 38 converts the signal voltages Vsg and Vsp to digital signals by an analog-to-digital converter (ADC). The CPU 38 controls a toner supply clutch 51 via a buffer 50 on the basis of the digital signals to thereby control the supply of the toner from the toner supply section 24 to the developing section 23. Assume that the latent image formed on the drum 11 is developed by a black toner by way of example. Then, so long as the toner concentration of the developer is adequate, the voltages Vsg and Vsp are 4 volts and 0.5 volt, respectively. If the voltage Vsg is lower than or equal to Vsp×8, the CPU 38 couples the clutch 51 for a predetermined period of time to supply the toner from the toner supply section 24; if the former is higher than the latter, the CPU 38 uncouples the clutch 51. Such an operation of the CPU 38 is conventional. When the developer existing in the developing section 23 is a mixture of color toner and carrier, the CPU 38 controls the toner supply in a particular manner which will be described later.

Figure 10:
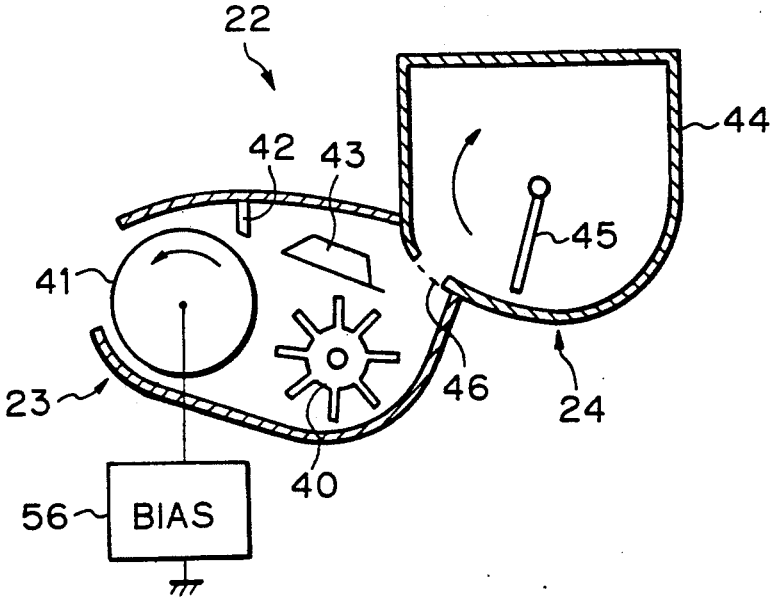
FIG. 10 is a section showing a developing device included in the copier.

As shown in FIG. 10, the developing section 23 and toner supply section 24 are formed integrally with each other to constitute the developing device 22, i.e., the developing device 22 is constructed into a unit. When a toner end condition is reached, the developing device 22 is bodily removed from the copier and replaced with another. The developing section 23 is loaded with 200 grams of developer. A paddle 40 is disposed in the developing section 23 to agitate the developer. A developing roller 41 is also located in the developing section 23 to convey the developer. A doctor blade 42 regulates the thickness of the developer deposited on the developing roller 41. A separator 43 returns the developer having been scraped off by the doctor blade 42 to the paddle 40. A bias voltage for development is applied from a bias power source 56 to the developing roller 41. The developing roller 41 and paddle 40 are rotated by the main motor 12. The toner supply section 24 has a hopper 44 storing a toner therein, an agitator 45 for supplying the toner from the hopper 44 to the developing section 23 while agitating it, and a perforated Mylar sheet 46 for regulating the amount of toner to be fed to the developing section 23. 300 grams of toner is stored in the hopper 44. The agitator 45 is selectively connected to a drive source by the toner supply clutch 51; when the clutch 51 is coupled, the agitator 45 is rotated to supply the toner.

Figure 11:
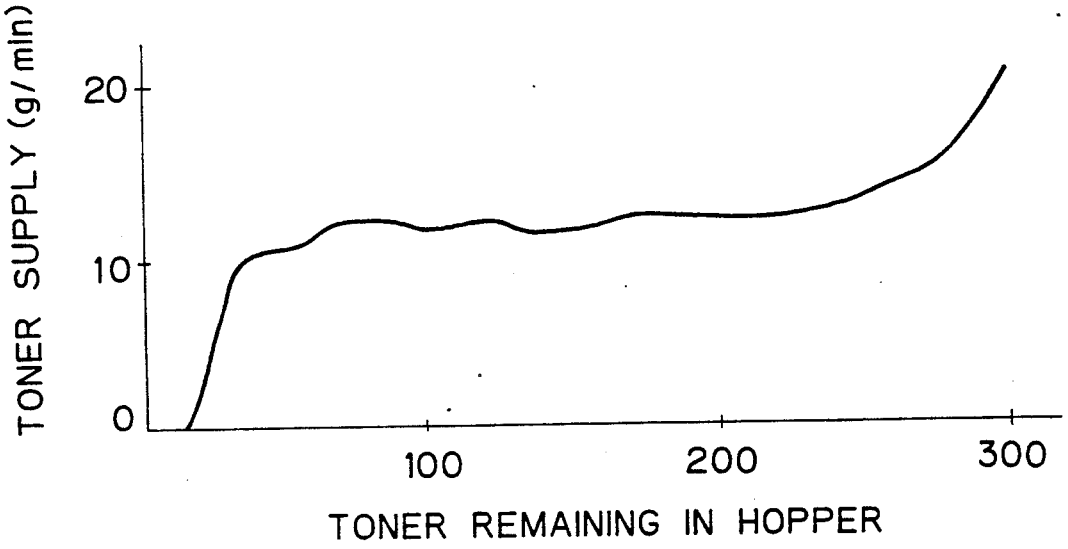
FIG. 11 is a graph showing a relation between the amount of toner remaining in a hopper included in the copier and the amount of toner supply.

FIG. 11 shows a relation between the amount of toner remaining in the hopper 44 and the amount of toner supplied by the agitator 45. As shown, when the hopper 44 is substantially full (300 grams), the agitator 45 supplies the toner at a rate of about 20 grams per minute. Thereafter, the toner supply rate decreases to 12 to 14 grams per minute and remains stable until the toner nearly ends.

Figure 12A:
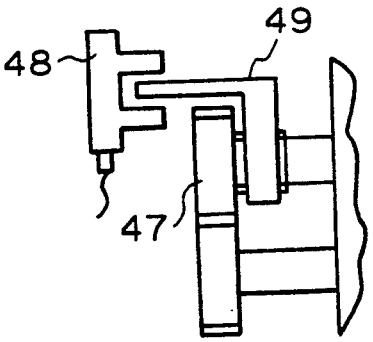
FIGS. 12A and 12B are front views each showing new developing device detecting means included in the copier in a particular position.
Figure 12B:
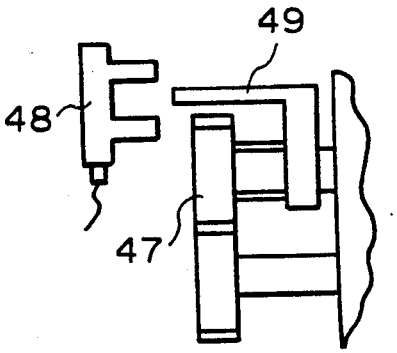

When a new developing device 22 is mounted on the copier, the developer stored in the developing section 23 has to be agitated over a predetermined period of time to increase the charge on the developer. FIGS. 12A and 12B show a specific form of means for discriminating a new developing device 22 from an old developing device 22. As shown, the developing device 22 has a gear 47 for rotating the paddle 40 by being rotated by the main motor 12. The gear 47 is mounted on a screw-threaded shaft. An intercepting member 49 is mounted on the shaft of the gear 47. As shown in FIG. 12A, when a new developing device 22 is mounted on the copier, the intercepting member 49 interrupts the optical path of a sensor 48 with the result that the output of the sensor 48 goes high. Then, the gear 47 is rotated by the main motor 12 to agitate the developer stored in the developing section 23, causing the intercepting member 49 to move to the right on the screw-threaded shaft of the gear 47. At the time when the developer in the developing section 23 has been agitated over a predetermined period of time, the intercepting member 49 is spaced apart from the sensor 48, as shown in FIG. 12B. Then, the output of the sensor 48 goes low.

When a new developing device 22 is detected by the above operation, the CPU 38 starts on an inching mode operation. Briefly, the inching mode operation includes agitating the developer of the device 22 for increasing the charge of the toner of the developer which has been lowered due to a long time of storage, and, in the event of color development, determining a toner control level for copying operations by detecting the amount of toner deposition in a predetermined electric field for development. On the change of the output of the sensor 48 from a high level to a low level, the CPU 38 sets up the inching mode and implements the above-mentioned functions by causing the copier to operate in substantially the same manner as in the ordinary copy mode. Specifically, as shown in FIG. 9, the CPU 38 energizes a relay 53 via a buffer 52 for a period of time sufficient to produce ten to fifteen copies, e.g., twenty copies. Then, the relay 53 drives the main motor 12 via a conact 53*a* thereof with the result that the paddle 40 is rotated to agitate the developer. In the latter half of the agitating operation, a latent image of the reference pattern 34 is electrostatically formed on the drum 11 and then trimmed to a suitable size by the eraser 33. The developing section 23 develops this latent image under a predetermined field condition. The density sensor or P sensor 35 senses the density of the resulting toner image and the background density of the drum 11.

While the density of the toner image of the reference pattern 34 and the background density are sensed several times in the final stage of the inching mode operation, the CPU 38 calculates a mean value of the ratios of the outputs Vspo of the P sensor 35 associated with the toner images to the outputs Vsg associated with the background, i.e., Vspo/Vsg. This is to determine a developing characteristic in relation to the developer having a particular toner concentration. On completing the inching mode operation, the CPU 38 causes the copier to start on a copying operation in response to a copy start signal from a copy start switch 55, while controlling the toner concentration. In the event of color development, the CPU 38 compares the ratio of the output voltage Vsp of the P sensor 35 associated with the toner image of the reference pattern 34 to the output voltage Vsg associated with the background, i.e., Vsp/Vsg with the above-mentioned inching data Vspo/Vsg (=toner concentration control level Rcontrol) and, based on the result of comparison, controls the toner supply clutch 51.

A push switch, not shown, is turned on or off depending on the kind of the toner stored in the developing device 22, i.e., a black toner or a color toner. When the signal from the push switch is representative of a black toner, the CPU 38 turns on or turns off the toner supply clutch 51 by determining whether or not the voltage Vsg is higher than or equal to Vsp×8 as stated earlier, thereby controlling the toner concentration to adequate one. If the toner is a color toner as indicated by the signal from the push switch, the CPU turns on the clutch 51 when Vsp/Vsg exceeds the toner concentration control level Rcontrol or turns it off when the former decreases to below the latter. Assigning a particular toner concentration control level to each of a black toner and a color toner as stated above is advantageous since the output of the P sensor 35 is susceptible to the performance of the developing device 22, e.g., scattering in the gap between the developing roller 41 and the drum 11, scattering in the characteristic of the roller 41, and scattering in the developer. Specifically, the output of the P sensor 35 is apt to fluctuate to such a degree that the actual toner concentration falls out of a target range (2 to 5 Wt %; ratio of toner to carrier in weight).

Assume that the developing section 23 is loaded with a black toner as indicated by the signal from the push switch. Then, when the ratio Vsp/Vsg is determined to be greater than or equal to 37.5 % two consecutive times, the CPU 38 sets up a toner end mode by determining that a toner end condition has been reached. Also, when the fifteenth copying cycle is completed after Vsp/Vsg has been determined to be greater than or equal to 25% ten consecutive times, the CPU 38 sets up a toner end mode. On the other hand, assume that the developing section 23 is loaded with a color toner. In such a case, the CPU 38 sets up a toner end mode when Vsp/Vsg is found to be greater than or equal to Rcontrol×1.2 two consecutive times or when the fifteeth copying cycle is completed after Vsp/Vsg has been found to be greater than or equal to Rcontrol×1.1 ten consecutive times. In the toner end mode, the CPU 38 inhibits the copier from operating while turning on a toner end indicator provided on a display 57.

To replace the developing device 22, the operator opens a front cover provided on the copier body. A switch is associated with the front cover to detect the opening and closing of the front cover. When the main switch of the copier body is turned off and then on, the CPU 38 executes before the ordinary procedure a recovery procedure for determining whether or not a toner end condition has been reached on the basis of the ratio Vsp/Vsg and, if the answer is negative, cancelling the toner end mode. Further, the CPU 38 executes the recovery procedure before the ordinary procedure on detecting that the front cover is opened and then closed in response to the output of the switch.

When use is made of a color toner, the CPU 38 executes the recovery procedure in the same manner as the last toner end detection. At this time, the latent image of the reference pattern is formed on the drum 11 without the lamp 16 being turned on, for the following reasons:

(1) If the lamp 16 is automatically turned in a recovery procedure as soon as the operator turns on the main switch of the copier body, the operator will feel uneasy;

(2) In a recovery procedure, the lamp 16 does not have to be turned on since the latent image of the reference pattern is formed on the drum 11 in a region other than an image forming region; and (3) The flare ascribable to the lamp 16 should be eliminated to stabilize the potential for forming the latent image of the reference pattern.

During ordinary toner density control, the CPU 38 turns on the lamp 16 for forming the latent image of the reference pattern while taking account of the start-up time of the lamp 16. The grid voltage Vg of the main charger 13 is selected to be −620 volts such that the potential Vp of the latent image of the reference pattern, including the flare due to the lamp 16, is −620 volts. By contrast, during recovery procedure wherein the flare due to the lamp 16 is zero, the grid voltage Vg of the charger 13 is selected to be −580 volts in order to set up the same potential Vp of the latent image of the reference pattern as during ordinary toner density control. Selecting a lower grid voltage (absolute value) Vg during recovery procedure than during ordinary toner end detection is to obtain the same latent image potential Vp of the reference pattern as during ordinary toner end detection. Alternatively, the bias voltage (absolute value) Vb to be applied from the bis source 56 to the developing roller 41 may be increased during recovery procedure than during ordinary toner end detection. For example, the CPU 38 may control the bias source 56 such that the bias voltage Vb is −260 volts for ordinary toner end detection and −300 volts for recovery procedure.

Regarding a recovery procedure associated with a black toner, the CPU 38 sets up the toner end mode when the ratio Vsp/Vsg is greater than or equal to 37.5%. Then, the CPU 38 inhibits the copying operation and turns on the toner end indicator provided on the display 57. Also, the CPU 38 sets up a toner near end mode when Vsp/Vsg is greater than or equal to 25.0% and smaller than or equal to 37.5% by determining that the toner has nearly ended. Then, the CPU 38 allows one more copy to be produced while turning on the toner end indicator of the display 57. Further, when Vsp/Vsg is smaller than 25.0%, the CPU 38 cancels the toner end mode or the toner near end mode and turns off the toner end indicator of the display 57, allowing the copier to perform the ordinary operation.

Figures 13, 13A:
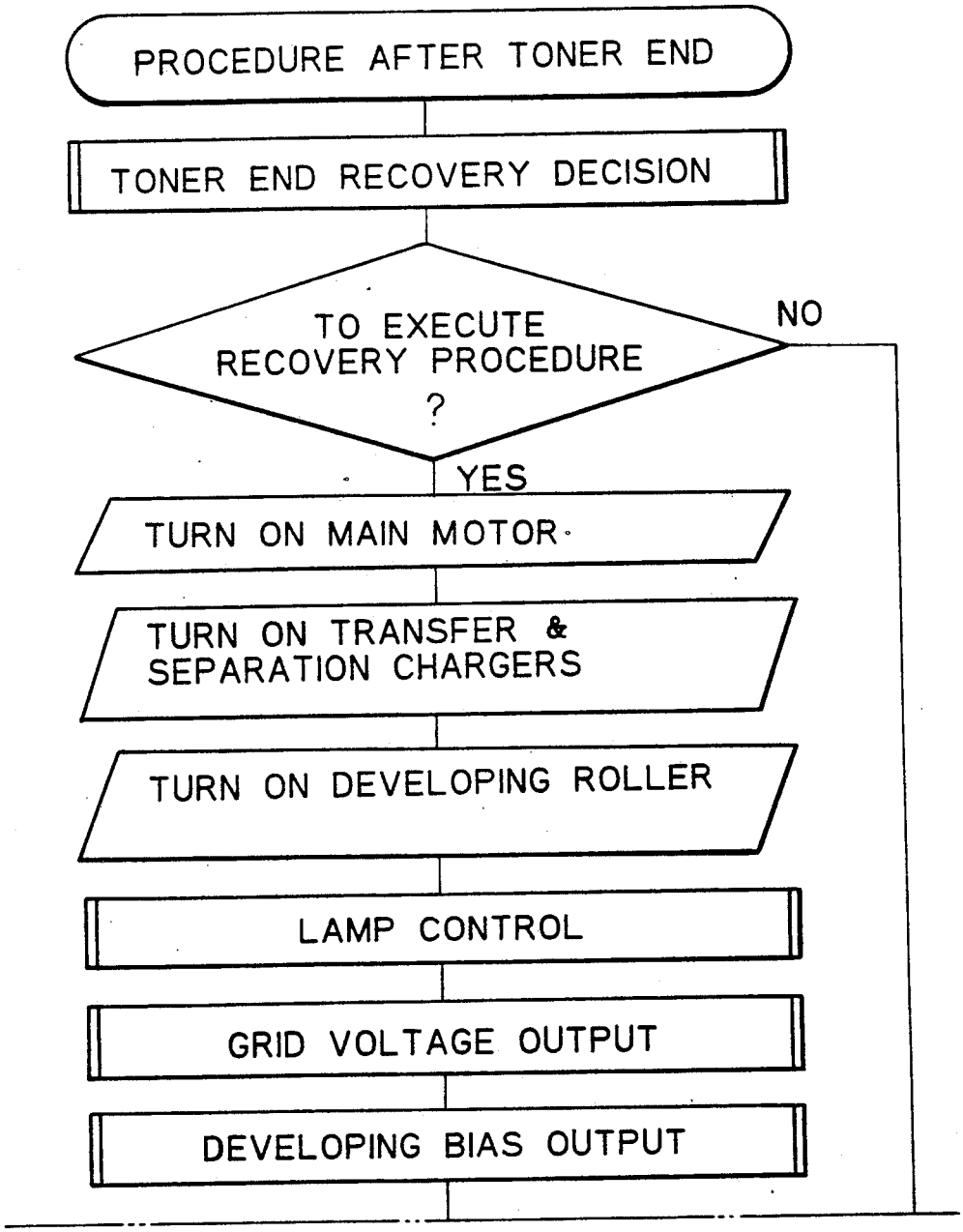
FIGS. 13-21 are flowcharts representative of a specific operation of a CPU included in the copier.
Figure 13B:
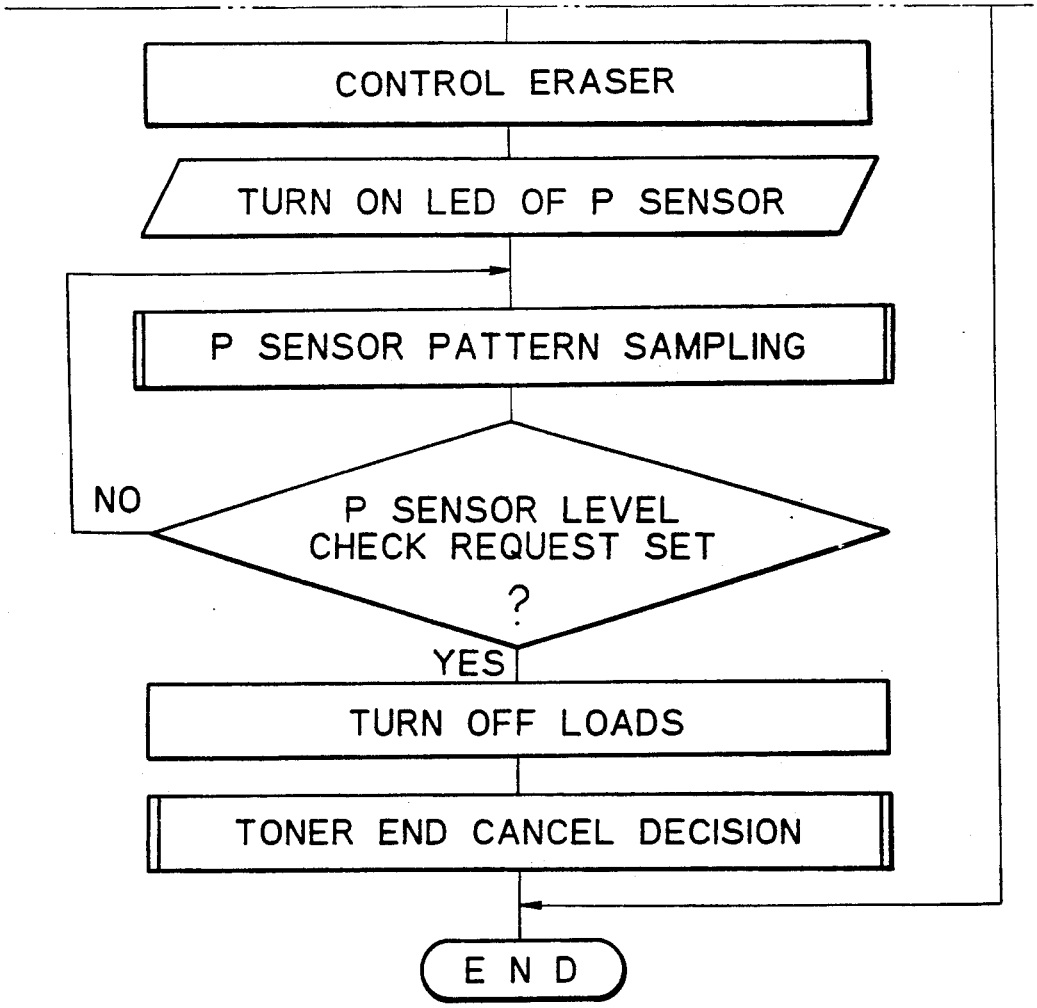
Figure 14:
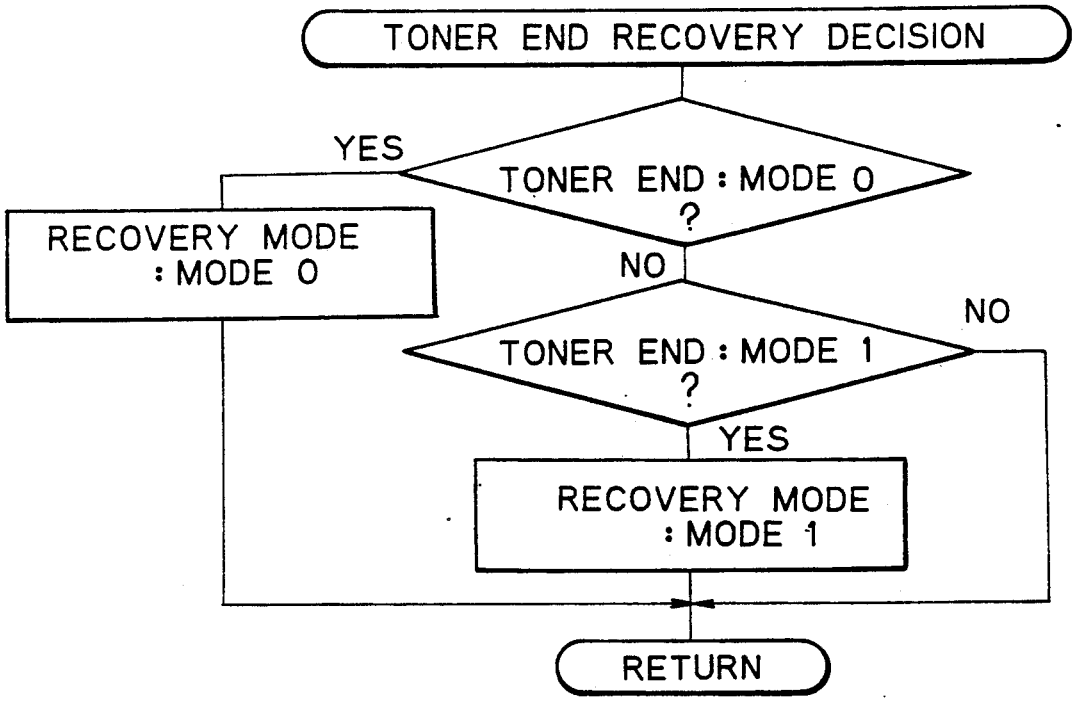

Referring to FIG. 13, there is shown a routine which the CPU 38 executes after the toner end condition has been reached, i.e., a routine for cancelling the copy inhibiting state (toner end mode) after the developing device 22 has been replaced. After the operator has opened the front cover of the copier body to replace the developing device 22 and then closed the front cover, the CPU 38 executes the routine of FIG. 13 in response to the resulting signal from the previously stated switch. First, the CPU 38 determines whether or not the toner end condition has been reached by a toner end recovery decision routine and, if it has been reached, sets up a recovery mode. Two different conditions for toner end dectection are provided, as stated earlier. The CPU 38 sets up one of a toner end mode 0 and a toner end mode 1, depending on the condition on which the end of toner has been detected. As shown in FIG. 14, in the toner end recovery decision routine, the CPU 38 executes a recovery mode 0 associated with the toner end mode 0 or a recovery mode 1 associated with the toner end mode 1, determining whether or not the toner has ended by using the same condition as during the toner end detection.

Figure 15:
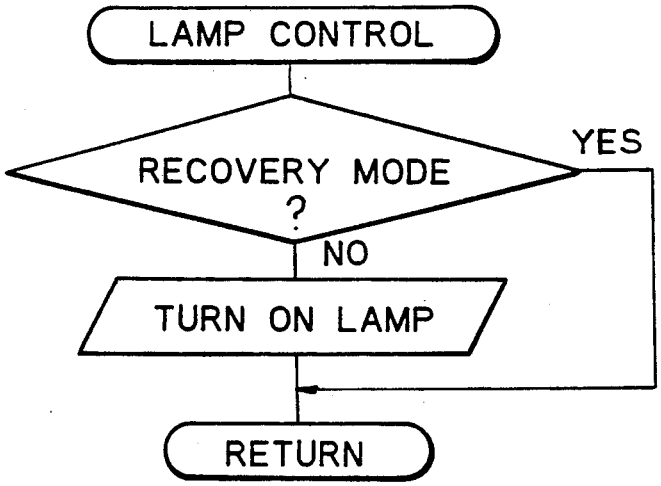
Figure 16:
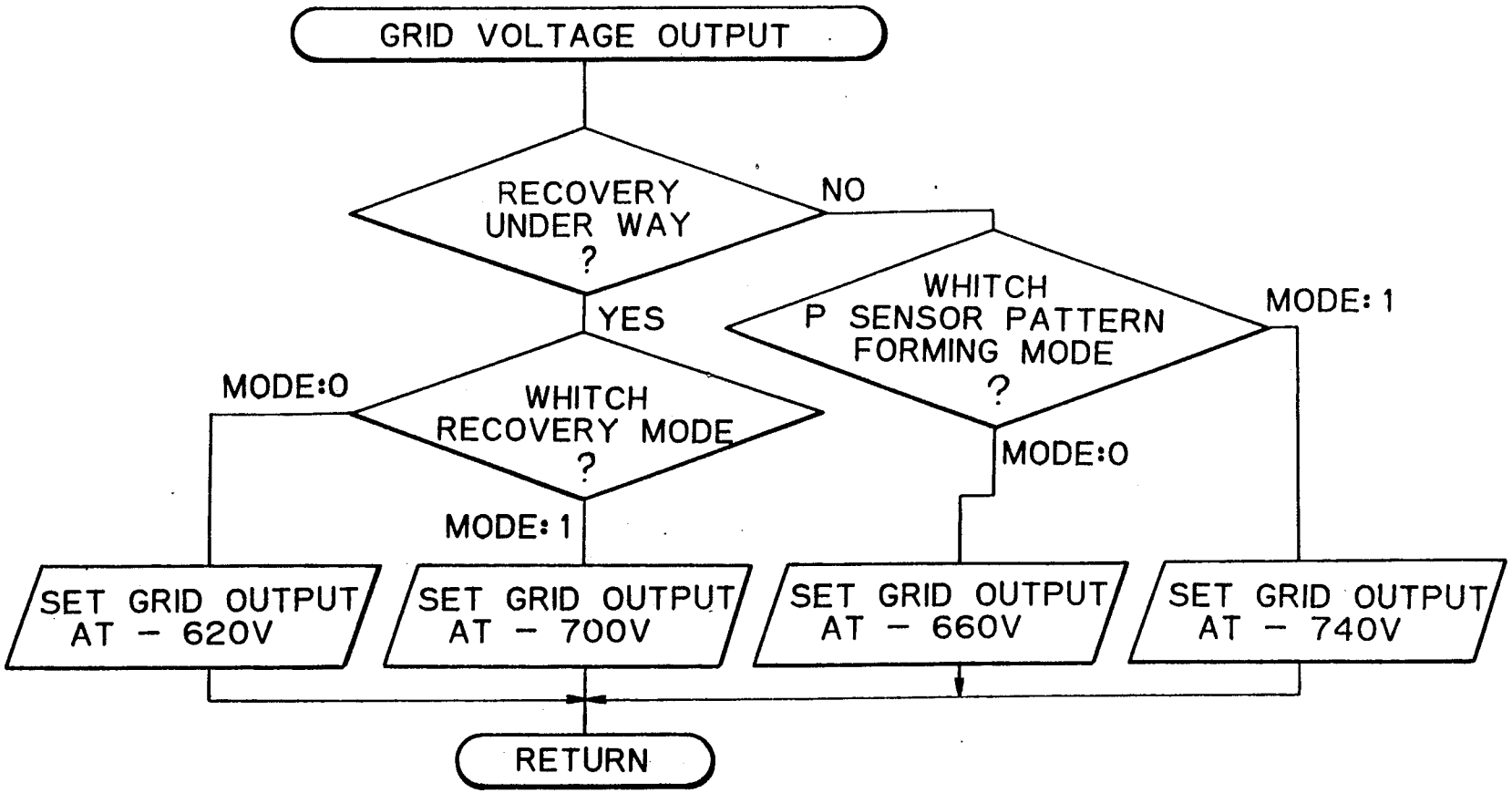
Figure 17:
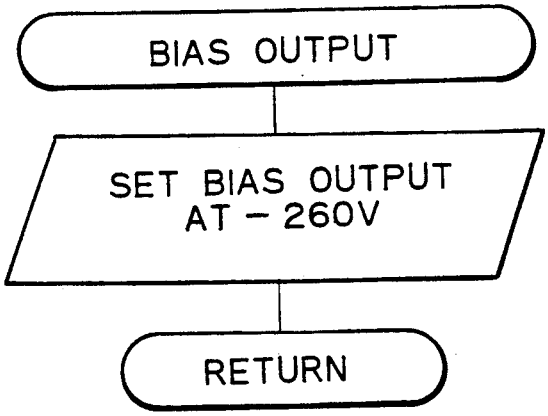

In the recovery mode, the CPU 38 energizes the main motor 12, turns on the main charger 13 and separation charger 28, renders the developing section 23 operative, and controls the grid voltage of the charger 13, the bias voltage of the bias source 56, and the eraser 33. As shown in FIG. 15, in the recovery mode, the CPU 38 does not turn on the lamp 16 and conrols the eraser 33 to electrostatically form a latent image of the reference pattern (a portion charged by the main charger 13 and not exposed) in the non-image area of the drum 11 while erasing the charge of the other area. The developing section 23 develops the latent image. As shown in FIG. 16, in the ordinary mode, the CPU 38 controls the grid voltage of the main charger 13 to −660 volts if the latent image of the reference pattern or P sensor pattern is formed in the mode 0 or to −740 volts if the mode of interest is the mode 1. As also shown in FIG. 16, in the recover mode, the CPU 38 controls the grid voltage of the main charger 13 to −620 volts if the mode is the mode 0 or to −700 volts if the mode is mode 1. Further, as shown in FIG. 17, the CPU 38 fixes the bias voltage of the bias source 56 at −260 volts. As a result, the ordinary mode and the recovery mode are matched regarding the potential for forming the latent image of the reference pattern.

Figure 19:
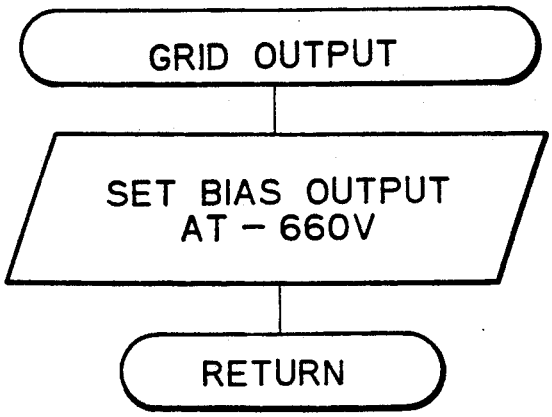
Figure 18:
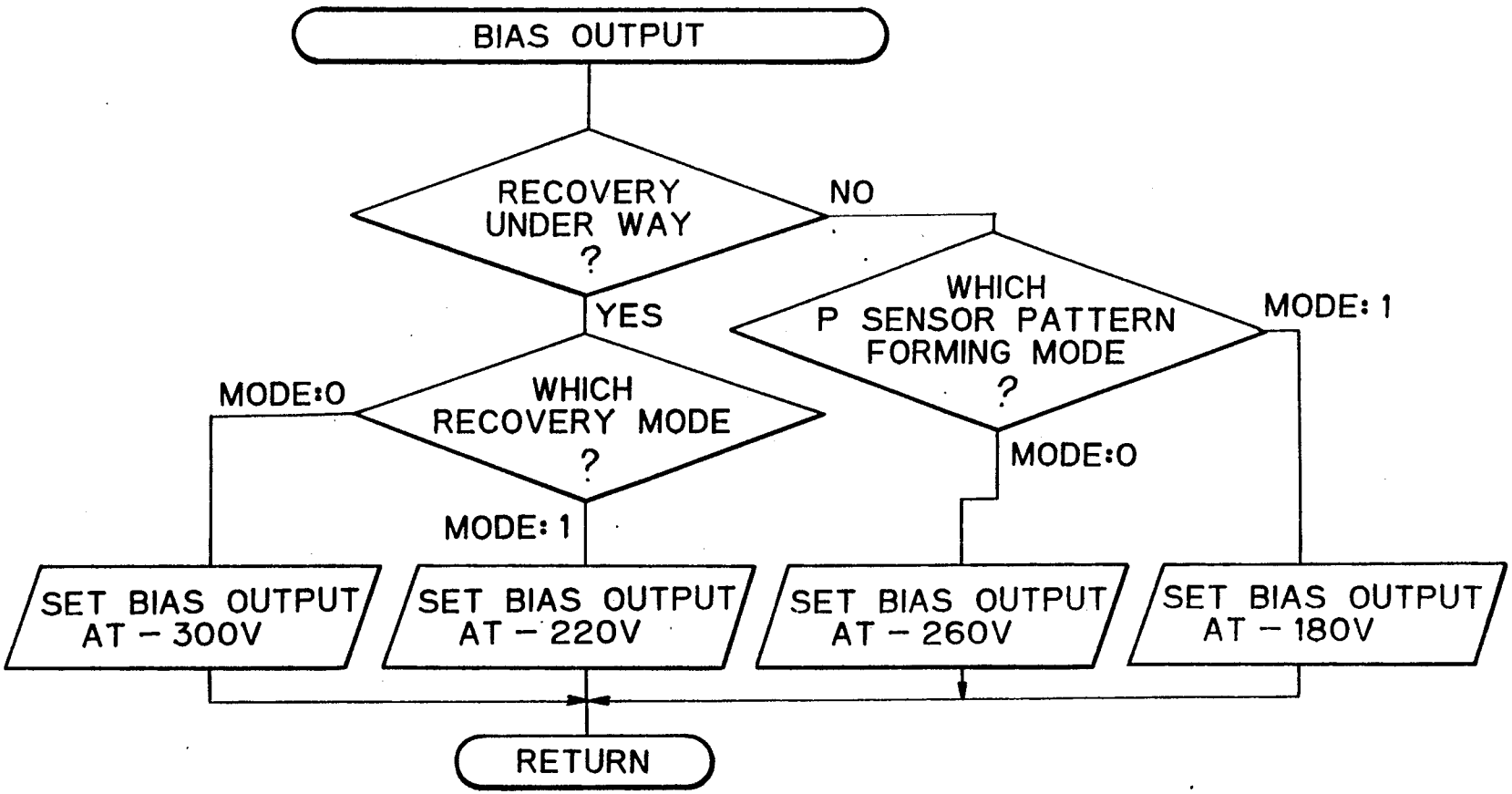
Figures 20, 20A, 20B:
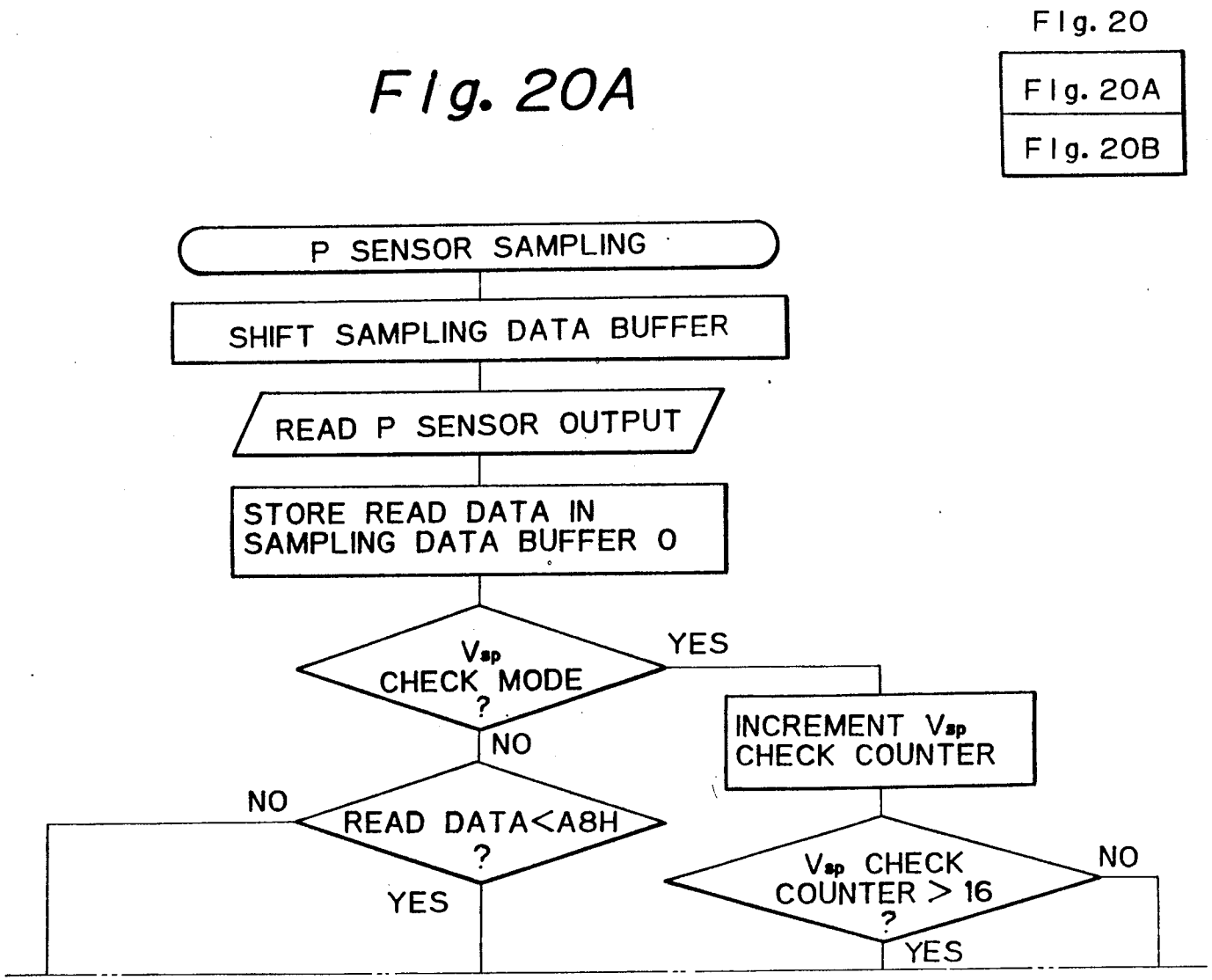
Figure 20B:
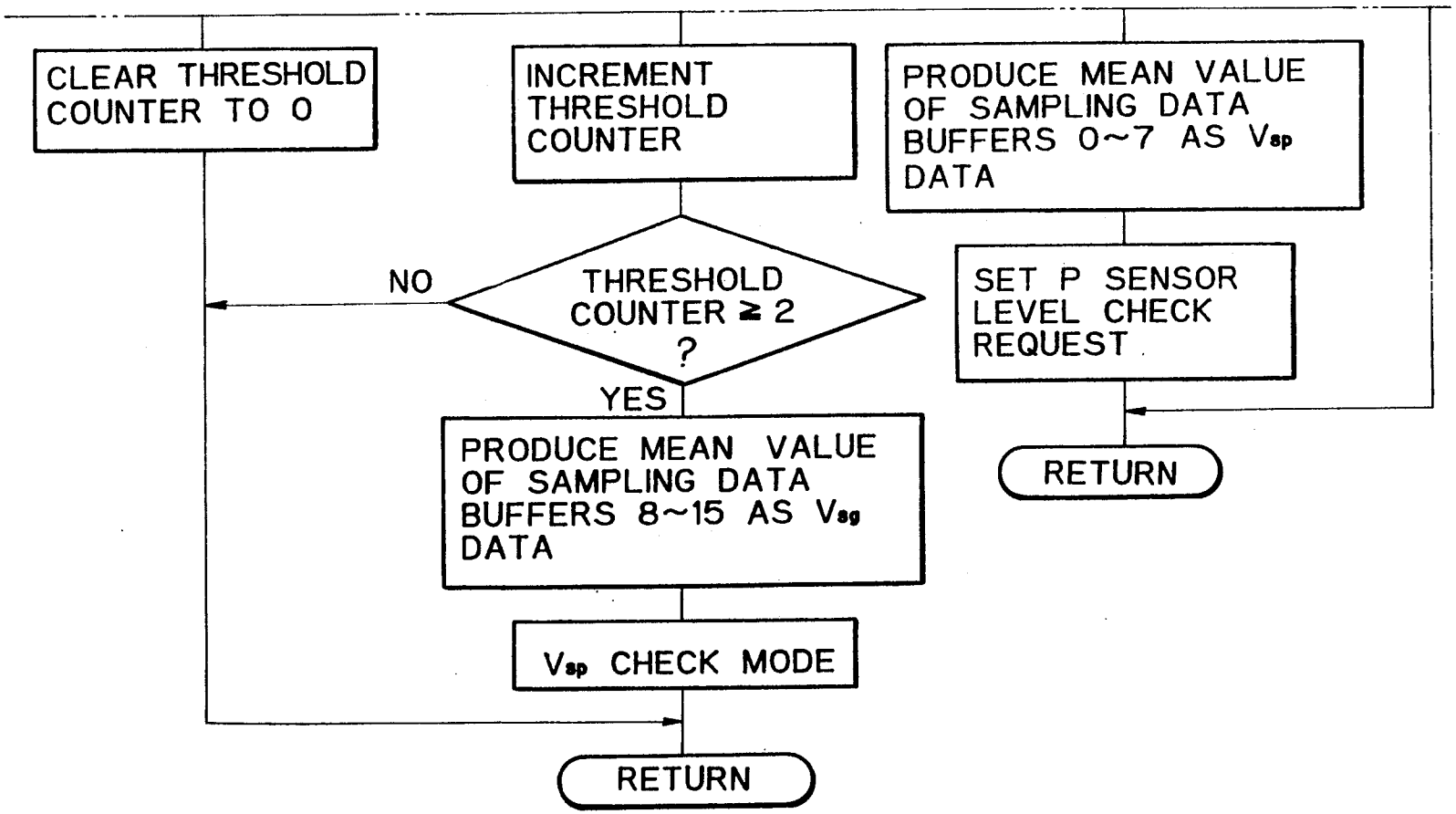

Alternatively, as shown in FIG. 18, the CPU 38 may control, in the ordinary mode, the bias voltage to −260 volts if the P sensor pattern forming mode is the mode 0 or to 1180 volts if the mode of interest is the mode 1. In the recovery mode, the CPU 38 may control the bias voltage to −300 volts if the mode of interest is the mode 0 or to −220 volts if it is the mode 1. In such a case, as shown in FIG. 19, the CPU 38 will fix the grid voltage of the main charger 13 at −660 volts. This is also successful in matching the ordinary mode and the recovery mode with respect to the reference pattern forming potential.

Referring again to FIG. 13, the CPU 38 turns on the P sensor 35 to execute a P sensor pattern sampling routine. This routine is repetitively executed at predetermined intervals (e.g. 4 milliseconds) from the time when the P sensor 35 is turned on to the end of the sampling of the output signals of the P sensor 35. The data 00H-FFH which the CPU 38 have read from the P sensor 35 via the ADC correspond to 0 volt to five volts. The data A8H, for example, corresponds to 3.3 volts. The LED 35*a* of the P sensor 35 turns on when the background area of the drum 11 preceding the toner image of the reference pattern 34 reaches the position of the P sensor 35. The CPU 38 sequentially stores the output signals of the P sensor 35 in a sampling data buffer via the ADC by sampling them and produces Vsg and Vsp from the sampling data. At this instant, while cancelling a Vsp check mode, the CPU 38 selects a threshold level A8H between the background of he drum 11 and the toner image of the reference pattern 34 and averages eight consective sampling data 15-8 samples before the point where data lower than the threshold level A8H has occurred two consecutive times, thereby producing Vsg. Then, the CPU 38 sets up the Vsp check mode. In the Vsp check mode, the CPU 38 averages eight consecutive data 9-16 samples after the point where data lower than the threshold level has occurred two consecutive times, thereby producing Vsp. Thereafter, the CPU 38 sets a P sensor level check request (flag).

Figure 22:
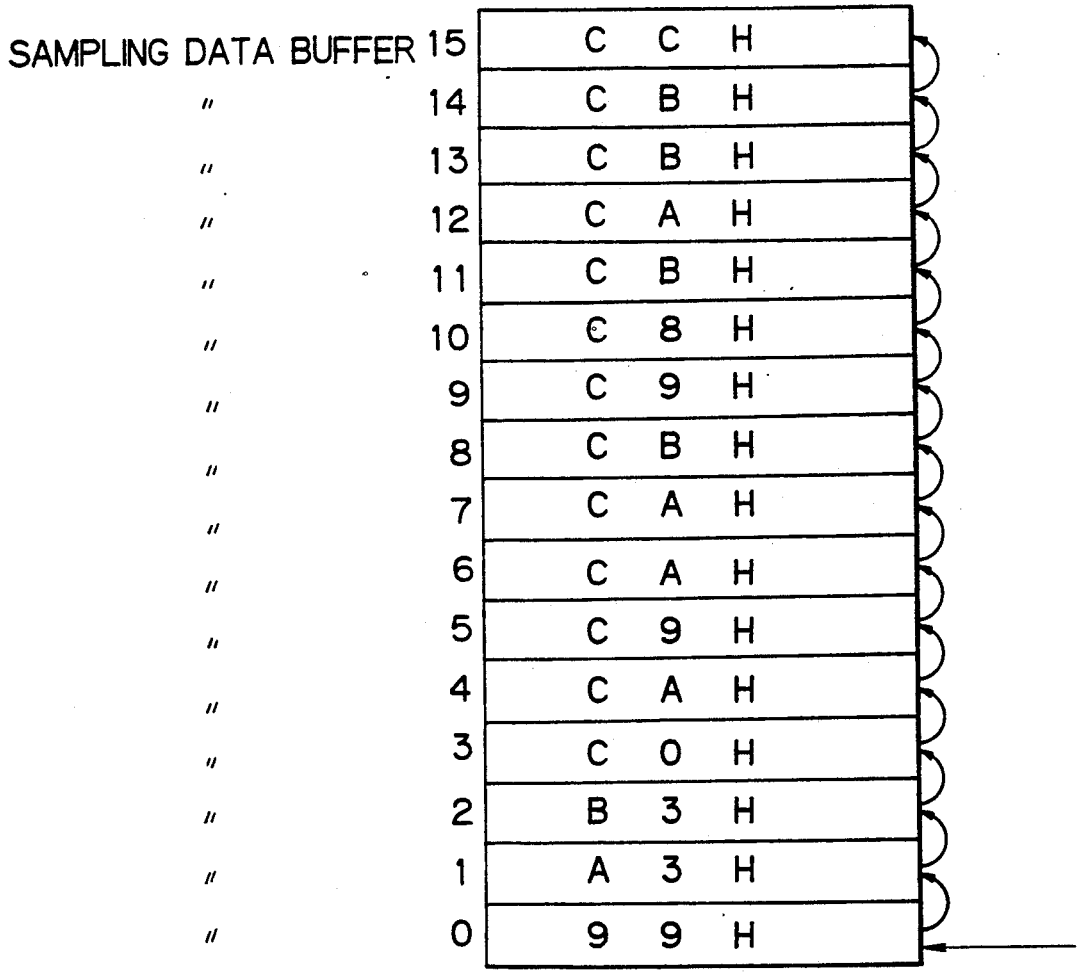
FIG. 22 shows a sampling data buffer included in the CPU.

As shown in FIG. 22, the sampling data buffer is implemented by a 16-byte area of a RAM. Every time new data is written to the buffer, the contents of the buffer are sequentially shifted upward by one byte. The buffer is capable of storing sixteen bytes of latest data. Before the sampling data decreases to below the threshold level, the CPU 38 intializes a threshold counter and a Vsp check counter to zero. By determining whether or not the threshold counter has reached "2", the CPU 38 sees whether or not the data has lowered to below the threshold level two consecutive times. Also, the CPU 38 increments the Vsp check counter every sampling in the Vsp check mode and determines whether or not the counter has exceeded "16" to see if the data being sampled follows sixteen samples having occurred after the two consecutive times of fall of the data to below the threshold level.

Figure 21:
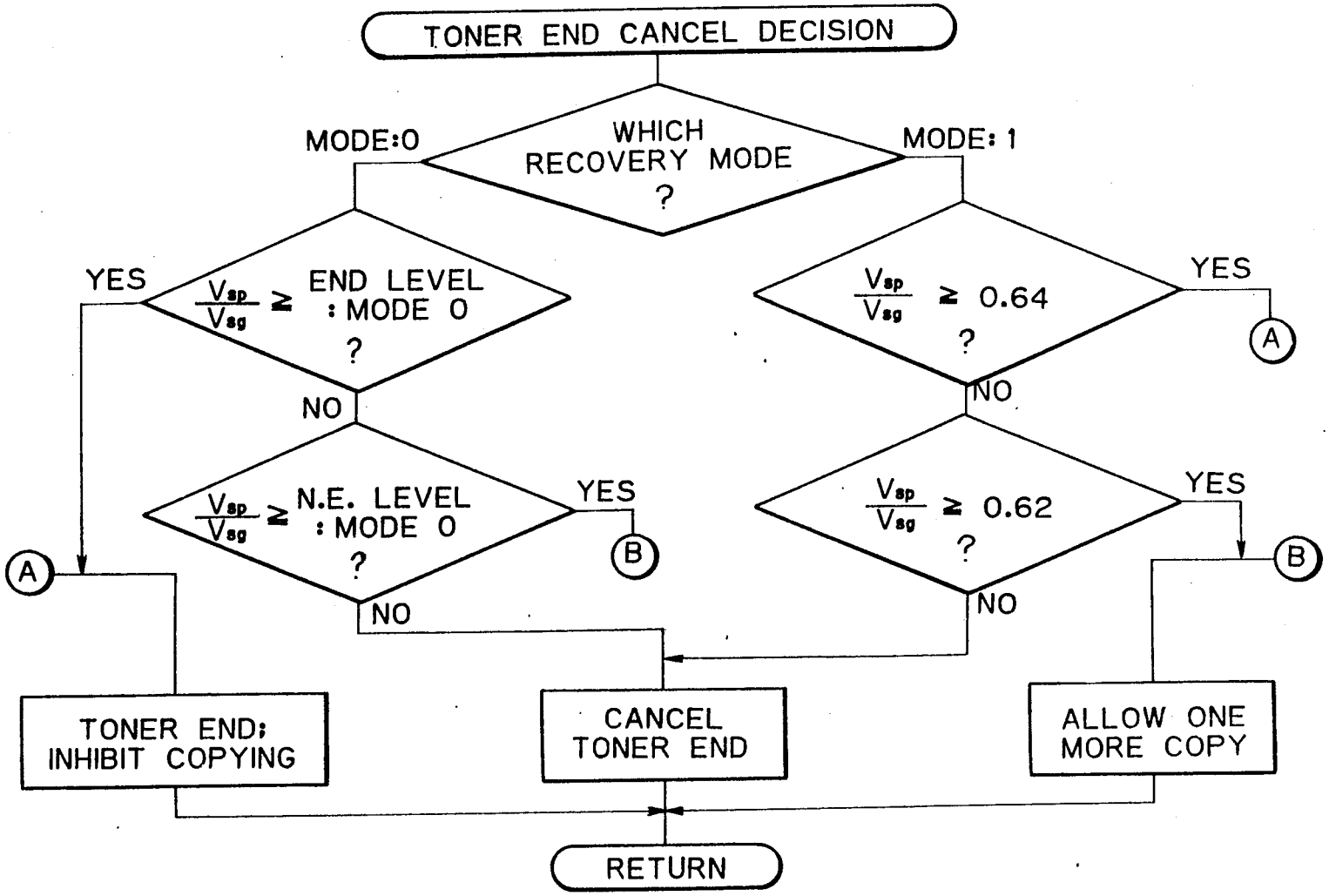

As shown in FIG. 13, when the P sensor level check request is set, the CPU 38 turns off the previously stated various loads and executes a toner end cancel decision routine. Specifically, as shown in FIG. 21, when the mode 0 is set up, the CPU 38 determines that the toner has ended if the ratio Vsp/Vsg is greater than or equal to Rcontrol×1.2, setting up the toner end mode to thereby inhibit the copier from operating. If Vsp/Vsg is smaller than Rcontrol×1.2 and greater than or equal to Rcontrol×1.1 as determined in the mode 0, the CPU 38 allows one more copy to be produced; if Vsp/Vsg is greater than Rcontrol×1.1, the CPU 38 determines that the toner has not ended and, therefore, cancels the toner end mode to allow the copier to operate. On the other hand, in the mode 1, the CPU 38 determines that the toner has ended if Vsp/Vsg is greater than or equal to 0.64, setting up the toner end mode. In the mode 1, the CPU 38 allows one more copy to be produced if Vsp/Vsg is smaller than 0.64 and greater than or equal to 0.62 or cancels the toner end mode if Vsp/Vsg is smaller than 0.62.

As stated above, the illustrative embodiment sets up a toner end mode when determined that the toner in the toner supply section 24 has ended in terms of the ratio Wsp/Vsg. When the power source of the copier body is turned off and then on or when the developing device is replaced, the embodiment determines whether or not the toner supply section is in a toner end condition on the basis of Vsp/Vsg and, if it is not in a toner end condition, cancels the toner end mode (recovery procedure). Hence, when a toner end condition is detected by accident due to, for example, the rapid consumption of toner during the continuous reproduction of documents whose substantial areas are occupied by images or when the developing unit not run out of toner is replaced with another storing a toner of the same color, the embodiment cancels the toner end mode and allows the copier to operate.

In the event of a recovery procedure, the lamp 15 is turned off. Should the lamp 16 be automatically turned in the recovery procedure to occur on the turn on of the main switch of the copier body, the operator would feed uneasy.

The grid voltage of the main charger 13 or the bias voltage to be applied to the developing section differs from the ordinary toner concentration detection to the recovery procedure. Therefore the recovery procedure is practicable with the same P sensor image forming potential as the ordinary toner concentration detection and, hence, with accuracy.

While the copier is in use, it is likely that a toner end condition is accidentally detected due to a change in the developing ability of the developing device 22 which is ascribable to a change in temperature or humidity. To eliminate this problem, the embodiment uses different detection conditions in the modes 0 and 1. Nevertheless, if the image forming condition (potential for forming the image of the reference pattern) is different from the recovery procedure to the ordinary toner end detection, a toner end condition may be detected by accident. To avoid such an occurrence, the embodiment matches the recovery procedure to the ordinary toner end detection as to the image forming condition by changing the grid voltage of the main charger 13 or the bias voltage in the recovery procedure depending on the grid voltage or the bias voltage in the toner end detection.

Various modifications will become possible for those skilled in the art after receiving the teachings of the present disclosure without departing from the scope thereof.

What is claimed is:

1. In a toner end detecting method for an electrophotographic copier, comprising the steps of:

electrostatically forming a latent image of a reference pattern on a photoconductive element;

developing said latent image by a developing section of a developing device for producing a toner image;

determining the density of said toner image and the density of the background of said photoconductive element by a density sensor;

controlling the supply of a toner from a toner supply section of said developing device to said developing section on the basis of a ratio of the outputs of said density sensor representative of the density of said background and the density of said toner image, respectively; and inhibiting a copying operation on determining that said toner supply section has reached a toner end condition;

the method further including executing a recovery procedure in which a toner end mode is set up when said toner supply section has reached a first toner end condition based upon said ratio, and wherein after said toner end mode is set up, said toner end mode is cancelled if said toner supply section has not reached a second toner end condition based upon said ratio and a power source of said copier is turned off and then on, said toner end mode also cancelled after set up if said toner supply section has not reached a second toner end condition based upon said ratio and said developing device has recently been set on said copier.

2. A method as claimed in claim 1, further including maintaining a lamp of said copier in an off condition during said recovery procedure.

3. A method as claimed in claim 1, further including the step of providing predetermined grid voltages to a scorotron charger for each of an ordinary toner end detection procedure and said recovery procedure.

4. A method as claimed in claim 1, further including the step of providing predetermined bias voltages to said developing section for each of an ordinary toner end detection procedure and said recovery procedure.

5. In a toner end detecting method for an electrophotographic copier, comprising the steps of:

electrostatically forming a latent image of a reference pattern on a photoconductive element;

developing said latent image by a developing section of a developing device for producing a toner image;

determining the density of said toner image and the density of the background of said photoconductive element by a density sensor;

controlling the supply of a toner from a toner supply section of said developing device to said developing section on the basis of a ratio of the outputs of said density sensor representative of the density of said background and the density of said toner image, respectively; and inhibiting a copying operation on determining that said toner supply section has reached a toner end condition;

the method further including executing a recovery procedure in which a toner end mode is set up when said toner supply has reached one of a plurality of toner end conditions based upon said ratio, and wherein after said toner end mode is set up, said toner end mode is cancelled if said toner supply section has not reached a second toner end condition based upon said ratio and a power source of said copier is turned off and then on, said toner end mode also being cancelled after set up if said toner supply section has not reached a second toner end condition based upon said ratio and said developing device has recently been set on said copier.

6. A method as claimed in claim 5, wherein a condition for forming said toner image during said recovery procedure is varied in matching relation to a condition for forming said toner image during said toner end detection procedure.

7. A method as claimed in claim 6, wherein a scorotron grid voltage for charging is varied during said recovery procedure in matching relation to a scorotron grid voltage assigned to said toner end detection procedure.

8. A method as claimed in claim 6, wherein a bias voltage to be applied to said developing section during said recovery procedure is varied in matching relation to a bias voltage to be applied to said developing section during said toner end detection procedure.

* * * * *